US005852347A

United States Patent [19]

Marcotte

[11] Patent Number: 5,852,347

[45] Date of Patent: Dec. 22, 1998

[54] LARGE-AREA COLOR AC PLASMA DISPLAY EMPLOYING DUAL DISCHARGE SITES AT EACH PIXEL SITE

[75] Inventor: Robert G. Marcotte, New Paltz, N.Y.

[73] Assignee: Matsushita Electric Industries, Osaka, Japan

[21] Appl. No.: 939,251

[22] Filed: Sep. 29, 1997

[51] Int. Cl.[6] ..... G09F 9/00

[52] U.S. Cl. ..... 315/169.4; 313/582; 345/55

[58] Field of Search ..... 313/582, 583, 313/584, 585, 586, 587; 315/169.4, 169.3, 169.1, 167, 168; 345/55, 67, 68

[56] References Cited

U.S. PATENT DOCUMENTS

| | | | |
|---|---|---|---|
| 4,728,864 | 3/1988 | Dick . | |
| 4,772,884 | 9/1988 | Weber et al. . | |
| 4,866,349 | 9/1989 | Weber et al. | 315/169.4 |
| 4,924,218 | 5/1990 | Weber et al. | 340/776 |

OTHER PUBLICATIONS

Sid 93 Digest, pp. 161–164, T. Shinoda et al., "Invited Address: Development of Technologies for Large–Area Color ac Plasma Displays".

*Primary Examiner*—Don Wong
*Assistant Examiner*—David H. Vu
*Attorney, Agent, or Firm*—Ohlandt, Greeley, Ruggiero & Perle

[57] ABSTRACT

An AC PDP incorporating the invention includes a first substrate having plural elongated address electrode structures, which include sets of color phosphors. A second substrate is opposed to the first substrate and encloses a dischargeable gas therebetween. The second substrate supports a plurality of scan electrode structures that are orthogonally oriented to the address electrode structures. Each scan electrode structure includes a scan loop with a first trace and a second trace and a plurality of sustain electrode structures that are interdigitated with the scan electrode structures, each sustain electrode structure including a first trace and a second trace. Address circuitry selectively applies address signals to the address electrode structures and scan circuitry applies a scan voltage to the scan electrode structures. Gas discharges occur at intersections between address electrode structures and both traces of a scan loop to which the scan voltage is applied, so as to create wall charges and dual subpixel sites for each color subpixel. Thereafter, a sustain signal applied to the sustain electrode causes discharges at each of the dual subpixel sites at which wall charges exist. Increased light and resolution are the result of the dual subpixel discharge sites.

9 Claims, 3 Drawing Sheets

$V_{WRITE}$
Vs
$V_{SCAN}$
0 V
SUSTAIN PULSE
ROW SELECT
WRITE PULSE
SCAN
Vs
0 V
ERASE
SUSTAIN
Vx
0 V
ADDRESS PULSE
XDATA
X
CYCLE 1
CYCLE 2
CYCLE 4
CYCLE 3

LARGE-AREA COLOR AC PLASMA DISPLAY EMPLOYING DUAL DISCHARGE SITES AT EACH PIXEL SITE

FIELD OF THE INVENTION

This invention relates to AC plasma display panels and, more particularly, to an improved large area color AC plasma display panel which exhibits improved image resolution.

BACKGROUND OF THE INVENTION

Color plasma display panels (PDPs) are well known in the art. FIG. 1 illustrates a first embodiment of a prior art AC color PDP wherein narrow electrodes are employed on the front panel. More particularly, the AC PDP of FIG. 1 includes a front plate with horizontal plural sustain electrodes 10 that are coupled to a sustain bus 12. A plurality of scan electrodes 14 are juxtaposed to sustain electrodes 10, and both electrode sets are covered by a dielectric layer (not shown). A back plate supports vertical barrier ribs 16 and plural vertical column conductors 18 (shown in phantom). The individual column conductors are covered with red, green or blue phosphors, as the case may be, to enable a full color display to be achieved. The front and rear plates are sealed together and the space therebetween is filled with a dischargeable gas.

Pixels are defined by the intersections of (i) an electrode pair comprising a sustain electrode 10 and a juxtaposed scan electrode 14 on the front plate and (ii) three back plate column electrodes 18 for red, green and blue, respectively. Subpixels correspond to individual red, green and blue column electrodes that intersect with the front plate electrode pair.

Subpixels are addressed by applying a combination of pulses to both the front sustain electrodes 10 and scan electrodes 14 and one or more selected column electrodes 18. Each addressed subpixel is then discharged continuously (i.e., sustained) by applying pulses only to the front plate electrode pair. A PDP utilizing a similar front plate electrode structure is shown in U.S. Pat. No. 4,728,864 to Dick.

Some PDPs have used wider transparent electrodes that are connected to a high conductivity feed electrode. Such an electrode structure is shown in FIG. 2 and includes transparent electrodes 20 which are coupled to sustain electrodes 10 and scan electrodes 14, respectively. In the configurations of both FIG. 1 and FIG. 2, the gap between the electrodes defines the electrical breakdown characteristic for the PDP. The width of the electrodes affects the pixel capacitance and, therefore, the discharge power requirements. The wider transparent electrodes 20 provide a means to input greater power levels to the PDP for increased brightness. However, the manufacturing cost of transparent electrodes 20 is much greater, due to the increased number of required processing steps.

Optically, the narrow electrode topology of FIG. 1 produces a significant amount of light on the outside of the electrodes, virtually eliminating any dark areas between pixel sites. By contrast, sustain electrodes 10 at the edges of transparent electrodes 20 create a shading of the light between the pixel sites, resulting in dark horizontal lines between pixel rows.

U.S. Pat. No. 4,772,884 to Weber et al. illustrates a further PDP design wherein plasma spreading or "coupling" is employed to couple the plasma at an address cell to one of a plurality of pixels that are adjacent to the addressed cell.

In such a PDP structure, loop-configured address electrodes and sustain electrodes are employed to enable selective control of plasma coupling. A description of other color PDP structures and modes of operation can be found in "Development of Technologies for Large-Area Color AC Plasma Displays", Shinoda et al., SID 93 Digest, pages 161–164.

There is a continuing need to improve the brightness of color PDPs and, more specifically, to reduce image graininess that is sometimes apparent.

Accordingly, it is an object of this invention to provide a color PDP which exhibits enhanced brightness.

It is another object of this invention to provide an improved color PDP which reduces a vertical graininess of an image and exhibits improved vertical resolution.

It is a further object of this invention to provide an improved color PDP wherein the operation of the electrode structures is less sensitive to electrode breaks.

SUMMARY OF THE INVENTION

An AC PDP incorporating the invention includes a first substrate having plural elongated address electrode structures, which include sets of color phosphors. A second substrate is opposed to the first substrate and encloses a dischargeable gas therebetween. The second substrate supports a plurality of scan electrode structures that are orthogonally oriented to the address electrode structures. Each scan electrode structure includes a scan loop with a first trace and a second trace and a plurality of sustain electrode structures that are interdigitated with the scan electrode structures, each sustain electrode structure including a first trace and a second trace. Address circuitry selectively applies address signals to the address electrode structures and scan circuitry applies a scan voltage to the scan electrode structures. Gas discharges occur at intersections between address electrode structures and both traces of a scan loop to which the scan voltage is applied, so as to create wall charges and dual subpixel sites for each color subpixel. Thereafter, a sustain signal applied to the sustain electrode causes discharges at each of the dual subpixel sites at which wall charges exist. Increased light and resolution are the result of the dual subpixel discharge sites.

DETAILED DESCRIPTION OF THE INVENTION

Figure 1:
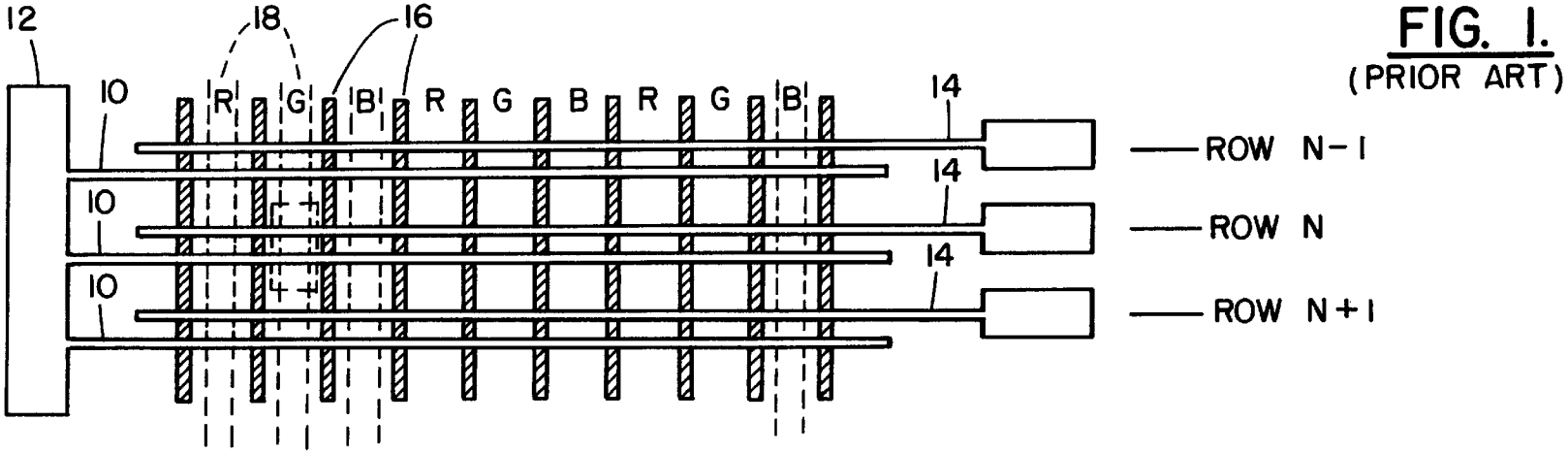
FIG. 1. (PRIOR ART)
FIG. 1 is a schematic diagram of a prior art color PDP using narrow, scan and sustain electrodes.
Figure 2:
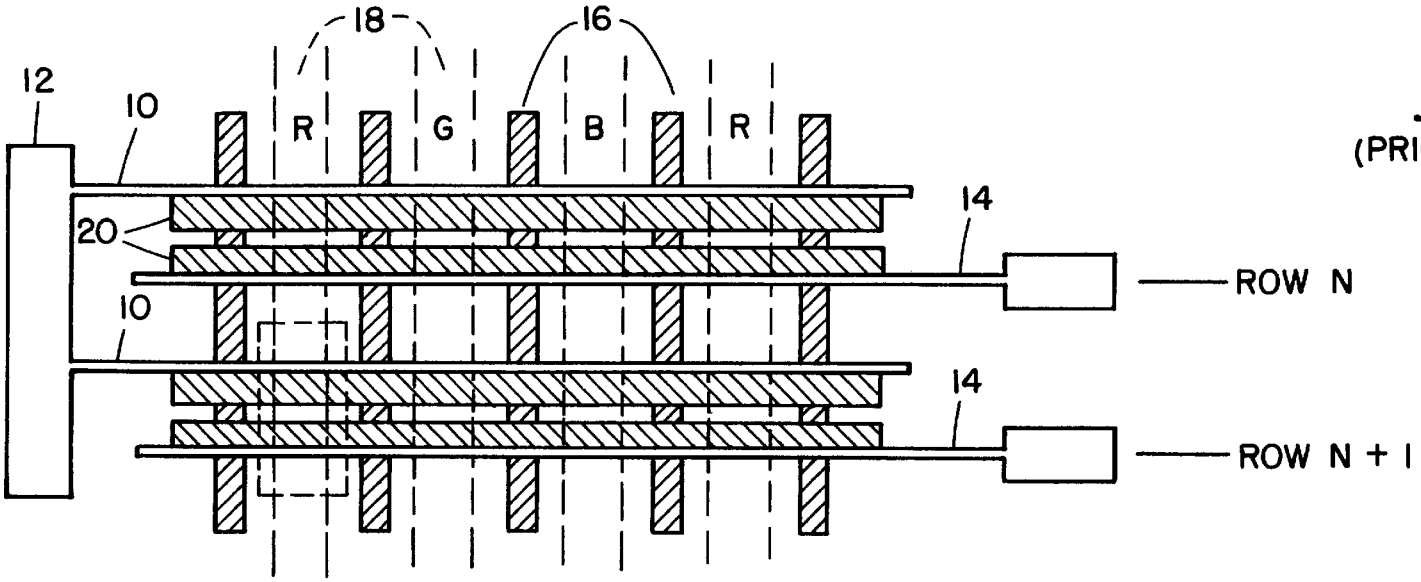
FIG. 2. (PRIOR ART)
FIG. 2 is a schematic diagram of a prior art PDP structure which employs transparent electrodes.

The invention to be described below builds upon the narrow electrode topology shown in FIG. 1, but extends that technology to larger area displays by configuring the narrow electrodes as loops. Such loops enable creation of dual discharge sites at each addressed subpixel, thereby enhancing the brightness and resolution of the resulting display and, further, improving the manufacturability of the PDP.

Figure 3:
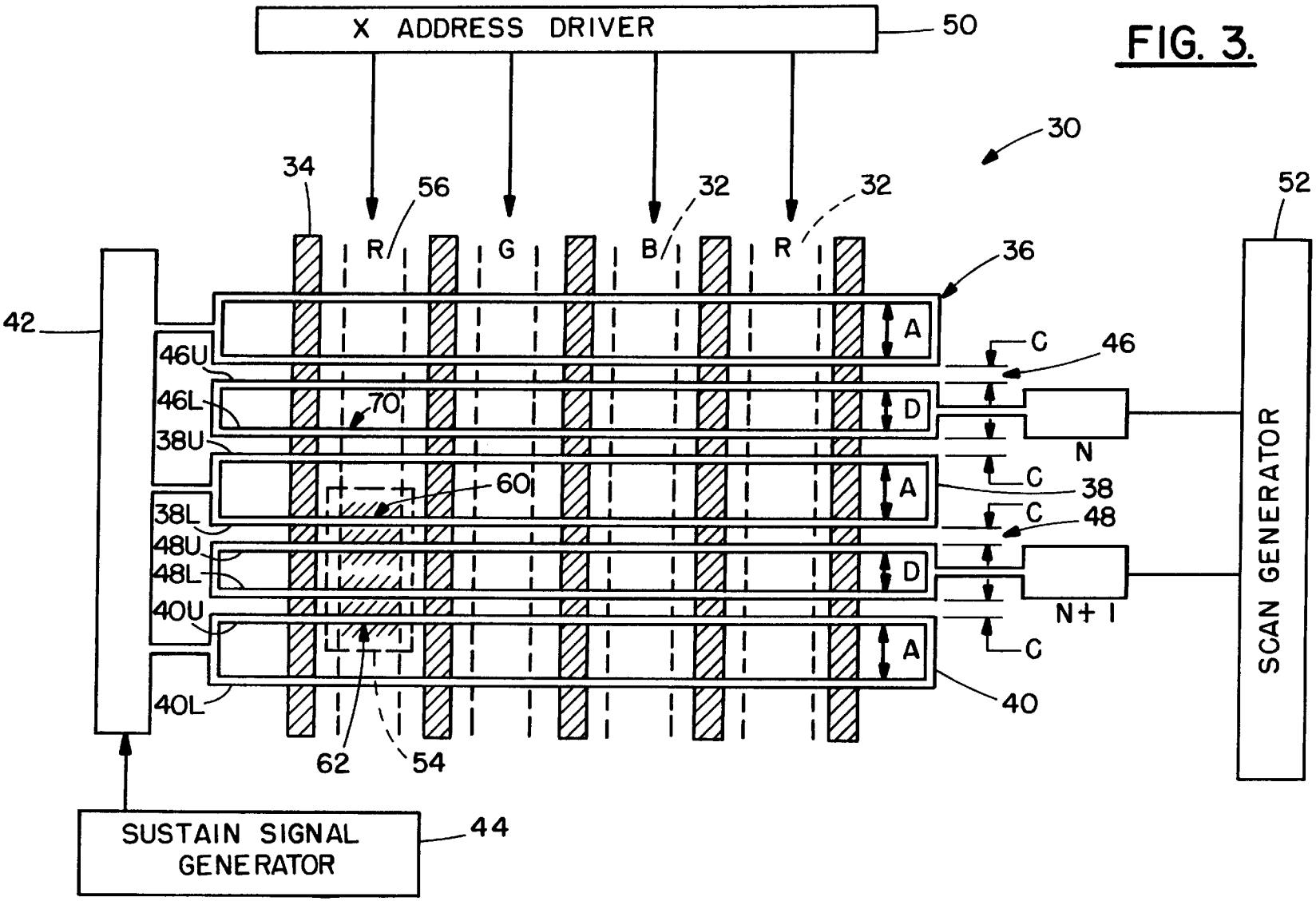
FIG. 3 is a schematic diagram of a PDP that incorporates the invention.

Referring to FIG. 3, a PDP 30 which incorporates the invention hereof, includes a rear panel (not shown) on which column electrodes 32 are positioned. Column electrodes 32 are respectively covered by red, green and blue phosphors. Each column electrode 32 is separated from each other column electrode 32 by a dielectric rib 34 which extends upwardly from the rear plate. A transparent front plate (not shown) supports a plurality of sustain loops 36, 38, 40, . . . etc., each sustain loop having an upper trace 36U, 38U, 40U . . . etc. and a lower trace 36L, 38L, 40L . . . etc. Each of sustain loops 36, 38 and 40 is coupled to a sustain bus 42 which, in turn, is connected to a sustain signal generator 44.

Scan loops 46, 48, . . . etc. are interdigitated between respective sustain loops 36, 38, 40 . . . etc. Thus, scan loop 46 is positioned between sustain loops 36 and 38 and scan loop 48 is positioned between sustain loops 38 and 40. Each of scan loop includes an upper trace (46U, 48U) and a lower trace (46L and 48L).

To selectively address a subpixel site, X address driver 50 selectively applies a column drive voltage to one or more column electrodes 32, while scan generator 52 sequentially scans each of scan electrodes 46, 48, etc. Assuming that a subpixel 54 is to be addressed (shown in phantom), X address driver 50 applies a column drive voltage to a column conductor 56. When scan generator 52 applies a scan voltage to scan loop 48, a discharge is created between both upper trace 48U, lower trace 48L and column conductor 56. As a result, a wall charge is established at discharge sites 60 and 62 (substantially immediately below traces 48U and 48L) on the dielectric layers which cover those traces.

Concurrently, a sustain potential is applied, via sustain signal generator 44 and sustain bus 42, to all sustain loops 36, 38 and 40 at the same time. Under such a condition, the wall charges present beneath traces 48U and 48L, in cooperation with the applied sustain potential, causes a discharge to occur between traces 38L, 48U and 48L, 40U, so as to "sustain" (i.e., cause discharges) at subpixel sites 60 and 62. Accordingly, each addressed subpixel includes dual discharging subpixel sites. To the viewer, discharging subpixel sites 60 and 62 tend to merge and manifest substantial levels of output illumination.

Certain features of the PDP structure shown in FIG. 3 are important to a properly operating PDP. Dimension C is the gas discharge gap which defines the two discharge sites on either side of a scan loop. Dimensions A and D are the inter-electrode distances between the traces of a sustain loop and a scan loop, respectively. In order to maintain substantially independent discharges at, for example, discharge site 60 and 62, dimension D must be kept large enough to prevent one discharge site from dominating during a discharge action with a column electrode 56. More specifically, if the traces of a scan loop are positioned too close to each other, then two distinct discharge sites are not achieved. In such case, one site will "hog" the discharge and will snuff out the other one, creating discharge voids during subsequent sustain cycles. Accordingly, the minimum scan loop dimension must be such as to assure substantially independent discharge actions upon application of address and scan potentials to the column electrodes and scan loops, respectively. Assuming a subpixel pitch of approximately 1.3 mm, distance D may preferably be set to approximately: 0.3 mm.

With respect to the sustain loops, dimension A must be set to exceed a minimum distance so as to prevent a discharge at a subpixel site (e.g., 60) from spreading to a discharge site of an adjacent subpixel (e.g., site 70). If dimension A is made too small, a discharge at site 60 will tend to spread across sustain loop 38 and cause an errant discharge at site 70. This will cause enough wall charge to be removed from site 70 that subsequent discharges will either be too weak or become non-existent. Accordingly, it is preferred, given a pixel pitch of approximately 1.3mm, that distance A be approximately 0.4 mm or larger.

With each gas discharge occurring across a gap C, the phosphor on the back plate is excited to produce light which is largely emitted through the discharge gap C. However, a significant amount of light is also emitted from the opposite side of the respective upper and lower traces of the sustain loops. Since light is produced on either side of four electrode traces per pixel, the light is seen as three small bright spots and two dimmer fringing spots. From a distance, the light disturbance caused by the shadowing of the electrodes is negligible and the viewer sees a crisp, clear, high resolution image.

An added benefit to the structure shown in FIG. 3 is that, during processing of the front plate, if a void occurs in one of the loop segments, the remainder of the loops is capable of maintaining the electrical integrity of the entire loop. When processing large plates, this can represent a substantial cost savings.

Figure 4:
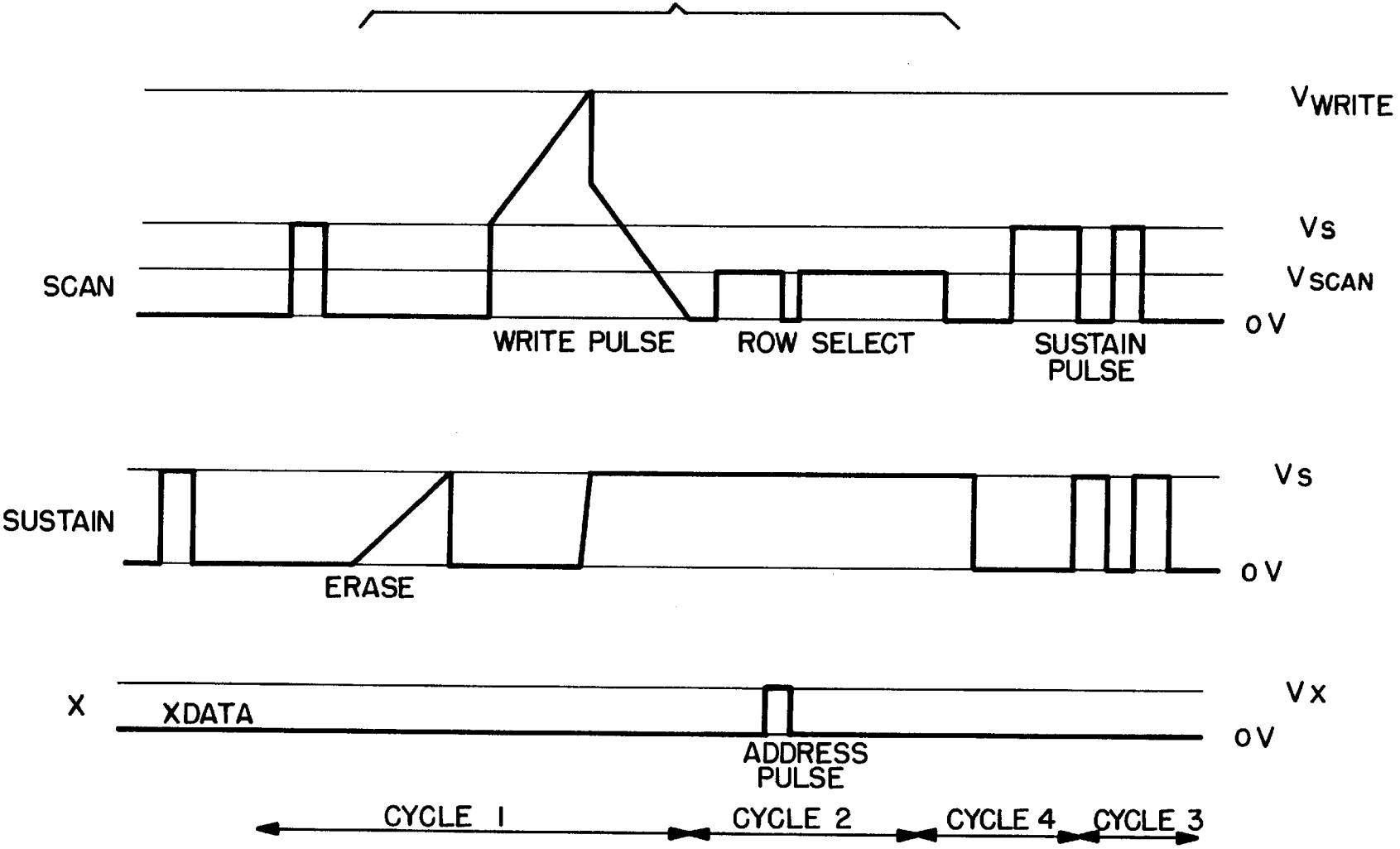
FIG. 4 is a set of waveform diagrams helpful in understanding the operation of the PDP of FIG. 3

Turning now to FIG. 4, a representative set of voltage waveforms is illustrated which enable operation of the PDP shown in FIG. 3. Initially, an erase pulse is applied to the sustain loops and erases each pixel site on the panel. Next, a write pulse is applied by scan generator 52 to all scan loops on the panel to cause a discharge to occur at each subpixel site. Thereafter, a high potential is applied to all sustain loops so that, in combination with a row select pulse applied to the scan loops and an address pulse applied to one or more column electrodes, a selective discharge of addressed subpixel sites is achieved. Thereafter, sustain signals are applied between the scan loops and sustain loops to achieve a continued discharge of the previously selected subpixel sites.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

I claim:

1. A color AC plasma display panel (PDP) comprising:

a) a first substrate having plural elongated address electrode structures including sets of color phosphors;

b) a second substrate in opposition to said first substrate and enclosing a dischargeable gas therebetween, said second substrate supporting i) a plurality of scan electrode structures orthogonally oriented to said address electrode structures, each scan electrode structure comprising a scan loop having a first elongated scan trace and a second elongated scan trace and ii) a plurality of sustain electrode structures in parallel configuration and interdigitated with said scan electrode structures, each sustain electrode structure comprising a sustain loop having a first elongated sustain trace and a second elongated sustain trace;

c) address means for selectively applying address signals to said address electrode structures;

d) scan means for applying a scan voltage to said scan electrode structures, so that gas discharges occur at intersections between addressed address electrode structures and a first elongated scan trace and a second elongated scan trace to which said scan voltage is applied, so as to create wall charges at dual discharge sites for each color subpixel;

e) sustain means for applying a sustain signal to said sustain electrode structures so as to discharge each of said dual discharge sites at which said wall charges have been created.

2. The color AC PDP as recited in claim 1, wherein each scan loop exhibits an intertrace distance of D between said first elongated scan trace and said second elongated scan trace, wherein D is sufficiently large to enable separate discharges to occur at intersections between said first elongated scan trace, said second elongated scan trace and an elongated address electrode structure, when scan and address voltage are respectively applied thereto.

3. The color AC PDP as recited in claim 1, wherein each sustain loop exhibits an intertrace distance of A between said first elongated sustain trace and said second elongated sustain trace, wherein A is sufficiently large to prevent a sustain discharge between one said sustain trace of said sustain conductive loop and an adjacent scan trace, from spreading to another said sustain trace of said conductive loop and an adjacent scan trace.

4. The color AC PDP as recited in claim 3, wherein each scan loop exhibits an intertrace distance of D between said first elongated scan trace and said second elongated scan trace, wherein D is sufficiently large to enable separate discharges to occur at intersections between said first elongated scan trace, said second elongated scan trace and an elongated address electrode structure, when scan and address voltages are respectively applied thereto, said intertrace distance of D being less than said intertrace distance of A.

5. The color AC PDP as recited in claim 1, wherein each set of color phosphors comprises red green and blue phosphors that are respectively positioned on sequences of said address electrode structures.

6. An AC plasma display panel (PDP) comprising:

a) a first substrate having plural elongated address electrode structures with dielectric layers present thereon;

b) a second substrate in opposition to said first substrate and enclosing a dischargeable gas therebetween, said second substrate supporting i) a plurality of scan electrode structures orthogonally oriented to said address electrode structures, each scan electrode structure comprising a scan conductive loop having a first elongated scan trace and a second elongated scan trace and ii) a plurality of sustain electrode structures in parallel configuration and interdigitated with said scan electrode structures, each sustain electrode structure comprising a sustain loop having a first elongated sustain trace and a second elongated sustain trace;

c) address means for selectively applying address signals to said address electrode structures;

d) scan means for applying a scan voltage to said scan electrode structures, so that gas discharges occur at intersections between addressed address electrode structures and a first elongated scan trace and a second elongated scan trace to which said scan voltage is applied, so as to create wall charges at dual discharge sites for each pixel;

e) sustain means for applying a sustain signal to said sustain electrode structures so as to discharge each of said dual discharge sites at which said wall charges have been created.

7. The AC PDP as recited in claim 6, wherein each scan conductive loop exhibits an intertrace distance of D between said first elongated scan trace and said second elongated scan trace, wherein D is sufficiently large to enable separate discharges to occur at intersections between said first elongated scan trace, said second elongated scan trace and an elongated address electrode structure, when scan and address voltages are respectively applied thereto.

8. The AC PDP as recited in claim 6, wherein each sustain conductive loop exhibits an intertrace distance of A between said first elongated sustain trace and said second elongated sustain trace, wherein A is sufficiently large to prevent a sustain discharge between one said sustain trace of said sustain conductive loop and an adjacent scan trace, from spreading to another said sustain trace of said conductive loop and an adjacent scan trace.

9. The AC PDP as recited in claim 8, wherein each scan loop exhibits an intertrace distance of D between said first elongated scan trace and said second elongated scan trace, wherein D is sufficiently large to enable separate discharges to occur at intersections between said first elongated scan trace, said second elongated scan trace and an elongated address electrode structure, when scan and address voltages are respectively applied thereto, said intertrace distance of D being less than said intertrace distance of A.

* * * * *